US010606203B1

(12) United States Patent
Koizumi

(10) Patent No.: US 10,606,203 B1
(45) Date of Patent: Mar. 31, 2020

(54) IMAGE FORMING APPARATUS AND CONTROL METHOD BY THE SAME

(71) Applicant: TOSHIBA TEC KABUSHIKI KAISHA, Shinagawa-ku, Tokyo (JP)

(72) Inventor: Susumu Koizumi, Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/200,697

(22) Filed: Nov. 27, 2018

(51) Int. Cl.
*G03G 15/00* (2006.01)

(52) U.S. Cl.
CPC ..... *G03G 15/5054* (2013.01)

(58) Field of Classification Search
CPC ..... G03G 15/6564; G03G 15/6567; G03G 2215/00409; G03G 2215/00721; G03G 15/235; G03G 15/5054
See application file for complete search history.

(56) References Cited

U.S. PATENT DOCUMENTS 5,239,341 A * 8/1993 Ishida ..... G03G 15/041 399/197
9,910,389 B1 * 3/2018 Ogasawara ..... G03G 15/5054
2008/0038004 A1 * 2/2008 Inoue ..... G03G 15/6564 399/394
2013/0216244 A1 * 8/2013 Miyazaki ..... G03G 15/5062 399/15
2014/0321871 A1 * 10/2014 Takagi ..... G03G 15/2028 399/68
2015/0071670 A1 * 3/2015 Sugiyama ..... G03G 15/205 399/70
2015/0338812 A1 * 11/2015 Miura ..... G03G 15/234 399/371

FOREIGN PATENT DOCUMENTS

JP 2015-196547 11/2015

* cited by examiner

*Primary Examiner* — Francis C Gray
(74) *Attorney, Agent, or Firm* — Amin, Turocy & Watson, LLP

(57) ABSTRACT

In accordance with an embodiment, an image forming apparatus comprises a conveyance section configured to convey a print medium; a processing unit configured to form a toner image; an image holding member configured to move the toner image formed by the processing unit; a photoelectric sensor facing the image holding member and of which a detection direction intersects with a conveyance plane on which the print medium is conveyed; and a processor configured to determine passage of the print medium based on the detection result of the photoelectric sensor, and to determine whether or not a density of the toner image formed by the processing unit is a preset density.

20 Claims, 8 Drawing Sheets

IMAGE FORMING APPARATUS AND CONTROL METHOD BY THE SAME

FIELD

Embodiments described herein relate generally to an image forming apparatus and a control method by the same.

BACKGROUND

An image forming apparatus forms a toner image and moves the formed toner image with an image holding member to transfer the toner image onto a print medium. The image forming apparatus fixes the toner image transferred onto the print medium with a fixing device. For example, the image forming apparatus forms a toner image on a photoconductive drum and enables a primary transfer belt as an image holding member to receive the toner image from the photoconductive drum. The toner image received by the primary transfer belt is transferred onto the print medium at a transfer nip where the print medium and the primary transfer belt contact with each other.

The image forming apparatus includes an image quality adjustment sensor for detecting a density of the toner image on the image holding member. The image forming apparatus adjusts the density of the toner image on the image holding member based on a detection result of the image quality adjustment sensor.

The image forming apparatus includes a passage sensor that detects whether or not the print medium reaches a secondary transfer position (transfer nip). The image forming apparatus determines whether or not the print medium reaches the transfer nip based on a detection result of the passage sensor. If it is determined that the print medium does not reach the transfer nip, the image forming apparatus stops the operation and makes a notification that a jam occurs.

However, in order to detect the density of the toner image and the passage of the print medium, the image forming apparatus needs to include both the image quality adjustment sensor and the passage sensor, resulting in an increase in cost and complexity.

DETAILED DESCRIPTION

In accordance with an embodiment, an image forming apparatus comprises a conveyance section configured to convey a print medium; a processing unit configured to form a toner image; an image holding member configured to move the toner image formed by the processing unit; a photoelectric sensor facing the image holding member and of which a detection direction intersects with a conveyance plane on which the print medium is conveyed; and a processor configured to determine passage of the print medium based on the detection result of the photoelectric sensor, and to determine whether or not a density of the toner image formed by the processing unit is a preset density.

Hereinafter, an image forming apparatus and a control method of the image forming apparatus according to several embodiments are described with reference to the accompanying drawings.

Figure 1:
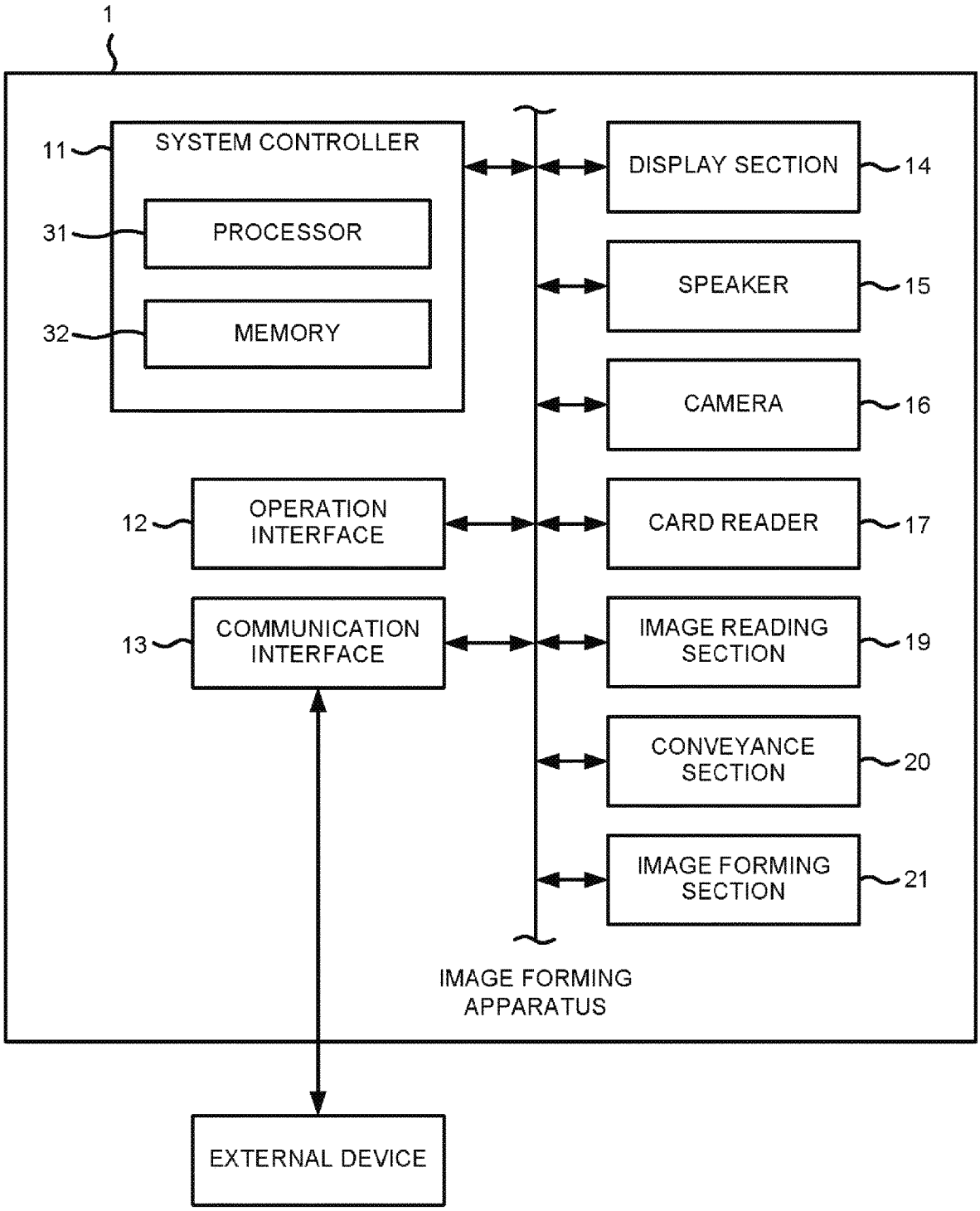
FIG. 1 is a diagram illustrating an example of a configuration of an image forming apparatus according to a first embodiment.
Figure 2:
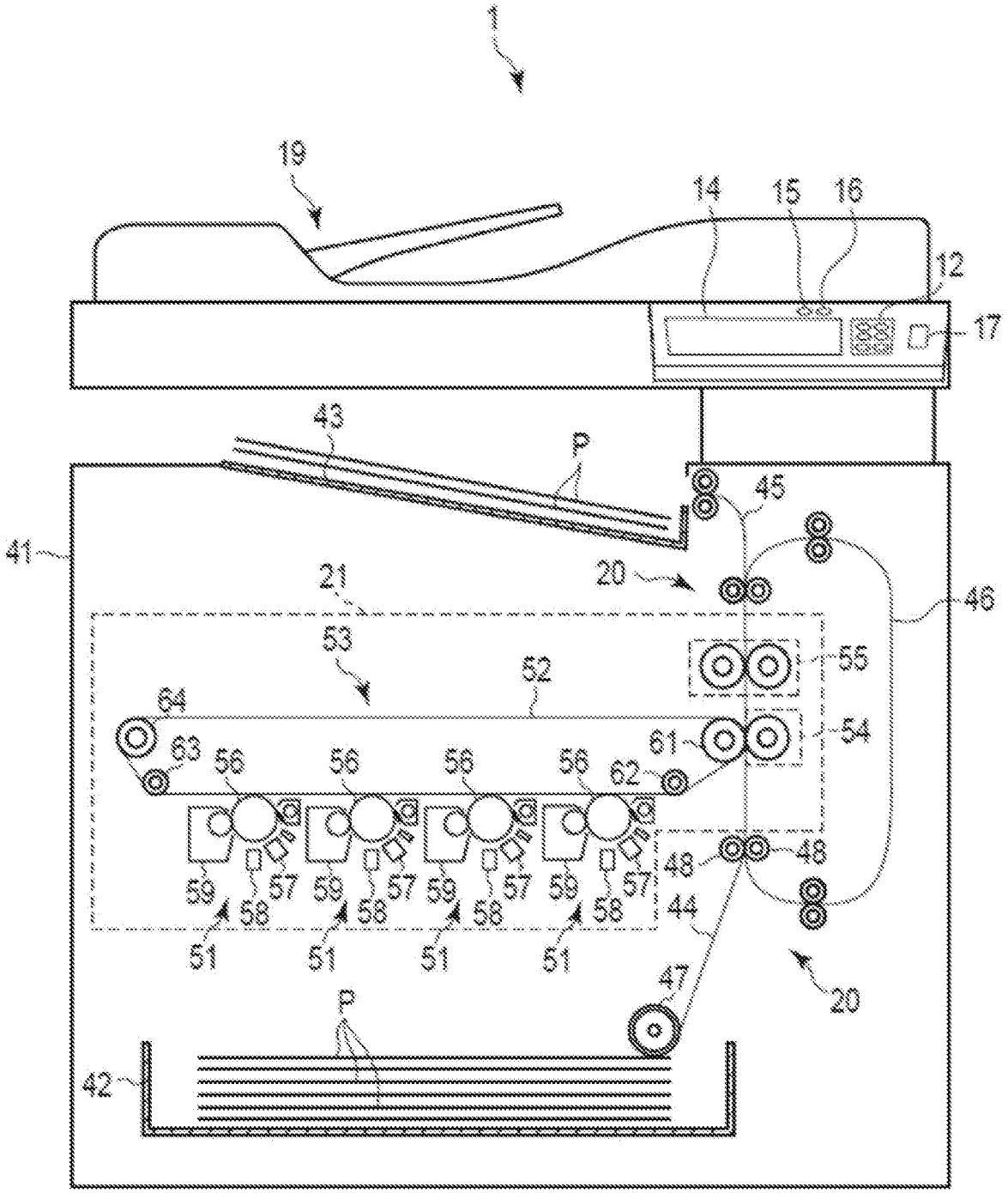
FIG. 2 is a diagram illustrating an example of a configuration of a processing unit according to the first embodiment.

FIG. 1 is a diagram illustrating an example of a configuration of an image forming apparatus 1 according to an embodiment. FIG. 2 is a diagram illustrating an example of configurations of a conveyance system and an image forming system of the image forming apparatus 1.

The image forming apparatus 1 is a multifunction printer (MFP) that performs various processing such as forming an image while conveying an image receiving medium such as a print medium. The image forming apparatus 1 is a solid-state scanning type printer (for example, an LED printer) that scans an LED array, which performs various processing such as forming an image while conveying an image receiving medium such as a print medium.

In the image forming apparatus 1, a primary transfer belt which is an image holding member receives a toner image from a photoconductive drum, the primary transfer belt then transfers the received toner image onto the print medium, and a fixing device fixes the toner image transferred onto the print medium.

As shown in FIG. 1, the image forming apparatus 1 comprises a system controller 11, an operation interface 12, a communication interface 13, a display section 14, a speaker 15, a camera 16, a card reader 17, an image reading section 19, a conveyance section 20, and an image forming section 21.

The system controller 11 controls the image forming apparatus 1. The system controller 11 includes, for example, a processor 31 and a memory 32. The system controller 11 is connected to the operation interface 12, the communication interface 13, the image reading section 19, the image forming section 21, the conveyance section 20, the display section 14, the speaker 15, the camera 16, and the card reader 17 through a bus or the like.

The processor 31 is an arithmetic element for executing an arithmetic processing. The processor 31 is, for example, a CPU (Central Processing Unit). The processor 31 performs various processing based on data such as programs stored in the memory 32. The processor 31 functions as a controller capable of executing various operations by executing the programs stored in the memory 32.

The memory 32 is a storage medium that stores programs and data used in the programs. The memory 32 also functions as a working memory. Specifically, the memory 32 temporarily stores data being processed by the processor 31, a program to be executed by the processor 31, and the like.

By executing the program stored in the memory 32, the processor 31 controls the operation interface 12, the communication interface 13, the image reading section 19, the image forming section 21, the conveyance section 20, the display section 14, the speaker 15, the camera 16, and the card reader 17.

The operation interface 12 is connected to an operation member (not shown). The operation interface 12 supplies an operation signal corresponding to an operation of the operation member to the system controller 11. The operation member is, for example, a touch sensor, a numeric keypad, a power key, a sheet feed key, various function keys, a keyboard, or the like. The touch sensor acquires information indicating a designated position within a certain region. The touch sensor is integrated with the display section 14 to function as a touch panel to input a signal indicating the touched position on a screen displayed on the display section 14 is input to the system controller 11.

The communication interface 13 is an interface for communicating with other devices. The communication interface 13 is used for communication with a host device (external device), for example. The communication interface is configured as, for example, a LAN connector. Furthermore, the communication interface 13 may perform wireless communication with other devices in conformity with a standard such as Bluetooth® Technology or Wi-fi® Technology.

The display section 14 includes a display for displaying a screen according to a video signal input from the system controller 11 or a display controller such as a graphic controller (not shown). For example, on the display of the display section 14, a screen for various settings of the image forming apparatus 1 is displayed.

The speaker 15 outputs voice according to a sound signal input from the system controller 11. For example, the speaker 15 outputs an alert as a voice to the user who operates the image forming apparatus 1.

The camera 16 acquires a face photograph of a person who operates the image forming apparatus 1. The camera 16 captures an image of a range in which a face of a user who operates the image forming apparatus 1 appears in a predetermined range in the vicinity of the image forming apparatus 1 to acquire a face photograph.

The card reader 17 is an interface for communicating with an IC card possessed by the user of the image forming apparatus 1. The card reader 17 transmits and receives data to and from the IC card by contact communication or non-contact communication.

The IC card includes an IC chip and a circuit for communication. The IC chip includes a CPU, a ROM (Read Only Memory), a RAM (Random Access Memory), a nonvolatile memory, and the like. The nonvolatile memory of the IC chip has identification information (user identification information) indicating the user who possesses the IC card. The circuit for communication is, for example, an antenna or a contact terminal (contact pattern). The circuit for communication is electrically or magnetically connected to the card reader 17.

The card reader 17 communicates with the IC card to acquire the identification information of the user who possesses the IC card from the IC card.

The image reading section 19 reads an image from a document. The image reading section 19 includes, for example, a scanner. Under the control of the system controller 11, the scanner acquires the image on the document. The scanner is provided in a space on the opposite side of a surface of a glass plate on which the document is placed. The scanner includes an image sensor, illumination, an optical element, and the like. The image sensor is an image capturing element in which pixels for converting light to electrical signals (image signals) are arranged in a line shape. The image sensor is, for example, a CCD (Charge Coupled Device), CMOS (Complementary Metal Oxide Semiconductor), or other image capturing devices. The illumination emits light through the glass plate to the document placed on the glass plate. The illumination includes a light source and a light guide for enabling the light from the light source to irradiate a range including a reading range of the optical element on the document. The optical element images the light from the predetermined reading range on the pixels of the image sensor. The reading range of the optical element is a line-shaped region. The optical element images the reflected light of the light emitted to the document from the illumination through the glass plate on the pixels of the image sensor.

If the print medium P is placed on the glass plate, the image reading section 19 moves the scanner with a driving mechanism (not shown) in a sub-scanning direction which is orthogonal to an arrangement direction (main scanning direction) of the pixels of the image sensor and parallel to a surface of the glass plate on which the document is placed. The scanner acquires the image data of the entire document by successively acquiring images in each line.

The image reading section 19 includes an ADF (Automatic Document Feeder). The ADF fetches the documents placed on a tray one by one, and conveys the fetched document in close contact with the glass plate. In this way, the document faces the glass plate. While the document is conveyed by the ADF, the scanner successively acquires an image in each line at a position facing the document. Thus, the scanner acquires the image data of the entire document.

Next, a conveyance system and an image forming system of the image forming apparatus 1 are described.

As shown in FIG. 2, the conveyance section 20 and the image forming section 21 of the image forming apparatus 1 are accommodated in a housing 41 of the image forming apparatus 1.

The conveyance section 20 conveys the print medium P in the image forming apparatus 1. As shown in FIG. 2, the conveyance section 20 includes a sheet feed cassette 42 and a sheet discharge tray 43.

The sheet feed cassette 42 accommodates a print medium P. The sheet feed cassette 42 can supply the print medium P from the outside of the housing 41. For example, the sheet feed cassette 42 can be drawn from the housing 41.

The sheet discharge tray 43 supports the print medium P discharged from the image forming apparatus 1.

The conveyance section 20 includes a sheet feed conveyance path 44, a sheet discharge conveyance path 45, and an reverse conveyance path 46, which are composed of a plurality of guides, a plurality of rollers, and a plurality of motors that are not shown.

The sheet feed conveyance path 44, the sheet discharge conveyance path 45, and the reverse conveyance path 46 convey the print medium P by enabling the motors operating under the control of the system controller 11 to rotate the rollers that rotates to move the print medium P while sandwiching the print medium P therebetween. The sheet feed conveyance path 44, the sheet discharge conveyance path 45, and the reverse conveyance path 46 restrict a moving direction of the print medium P with a plurality of guides so that the print medium P is conveyed along a correct conveyance plane. A part of the guides is rotated by the motors operating under the control of the system controller 11 to switch conveyance paths for conveying the print medium P.

The sheet feed conveyance path 44 is used for supplying the print medium P accommodated in the sheet feed cassette 42 to the image forming section 21. The sheet feed conveyance path 44 includes a fetching roller 47 that takes the print medium P accommodated in the sheet feed cassette 42 into the sheet feed conveyance path 44. The sheet feed conveyance path 44 includes a registration roller 48 that feeds the print medium P taken in by the fetching roller 47 to a secondary transfer position (transfer nip).

The sheet discharge conveyance path 45 is used for discharging the print medium P on which an image is formed by the image forming section 21 from the housing 41. The print medium P discharged by the sheet discharge conveyance path 45 is discharged to the sheet discharge tray 43.

The reverse conveyance path 46 is used to supply the print medium P again to the image forming section 21 after reversing the back and front surfaces and the front and rear ends of the print medium P on which an image is formed by the image forming section 21.

First Embodiment

Hereinafter, the image forming section 21 of the image forming apparatus 1 according to the first embodiment is described.

The image forming section 21 is a unit for forming an image on the print medium P under the control of the system controller 11. As shown in FIG. 2, the image forming section 21 includes a plurality of processing units 51, a primary transfer unit 53 having a primary transfer belt 52, a secondary transfer unit 54, and a fixing unit 55.

The processing unit 51 forms a toner image. Each of the plurality of the processing units 51 includes a photoconductive drum 56, an electrostatic charger 57, an exposure device 58, a developing device 59, and a loading section (not shown) in which a toner cartridge is loaded. The toner cartridges filled with toners of different colors such as cyan, magenta, yellow and black are loaded in the loading sections of the plurality of the processing units 51, respectively. Specifically, a plurality of the processing units 51 are provided in accordance with the types of toners. Since the plurality of the processing units 51 have the same configuration except for the developer filled therein, one processing unit 51 is described.

The photoconductive drum 56 includes a cylindrical drum and a photoconductive layer formed on an outer circumferential surface of the drum. The photoconductive drum 56 rotates at a constant speed by a driving mechanism (not shown). The photoconductive drum 56 is provided to contact with the outer circumferential surface of the primary transfer belt 52 of the primary transfer unit 53.

The electrostatic charger 57 uniformly charges the surface of the photoconductive drum 56. For example, the electrostatic charger 57 uses a charging roller to charge the photoconductive drum 56 with a uniform negative potential. The electrostatic charger 57 is rotated by the rotation of the photoconductive drum 56 with a predetermined pressure applied to the photoconductive drum 56.

The exposure device 58 includes a light emitting element such as a laser diode or a LED (Light Emitting Diode). The exposure device 58 forms an electrostatic latent image on the surface of the photoconductive drum 56 by irradiating the charged photoconductive drum 56 with a laser beam by using the light emitting element based on the image data.

The developing device 59 is used for attaching the toner to the photoconductive drum 56. The developing device 59 includes a developer container, a developing sleeve, a doctor blade, and a stirring mechanism for stirring the toner. The developer container accommodates the developer containing the toner and carrier. The developer is filled from the toner cartridge loaded in the loading section. The developing sleeve attaches the developer to the surface by rotating at the inside of the developer container. The doctor blade is arranged with a predetermined distance from the developing sleeve. The doctor blade adjusts a thickness of the developer adhering to the surface of the developing sleeve.

In the above configuration, if the developer layer formed on the surface of the developing sleeve contacts with the surface of the photoconductive drum 56, the toner contained in the developer adheres to the latent image formed on the surface of the photoconductive drum 56. As a result, the toner image is formed on the surface of the photoconductive drum 56. In other words, the photoconductive drum 56 functions as the image holding member for holding the toner image. When the photoconductive drum 56 and the primary transfer belt 52 contact with each other, the toner image on the surface of the photoconductive drum 56 is transferred onto the primary transfer belt 52. The processing unit 51 includes a cleaner which removes the remaining toner that is not transferred onto the primary transfer belt 52 from the photoconductive drum 56 using a blade in contact with the photoconductive drum 56.

The primary transfer unit 53 receives the toner image from a plurality of the processing units 51 and transfers the received toner images onto the print medium P.

Figure 3:
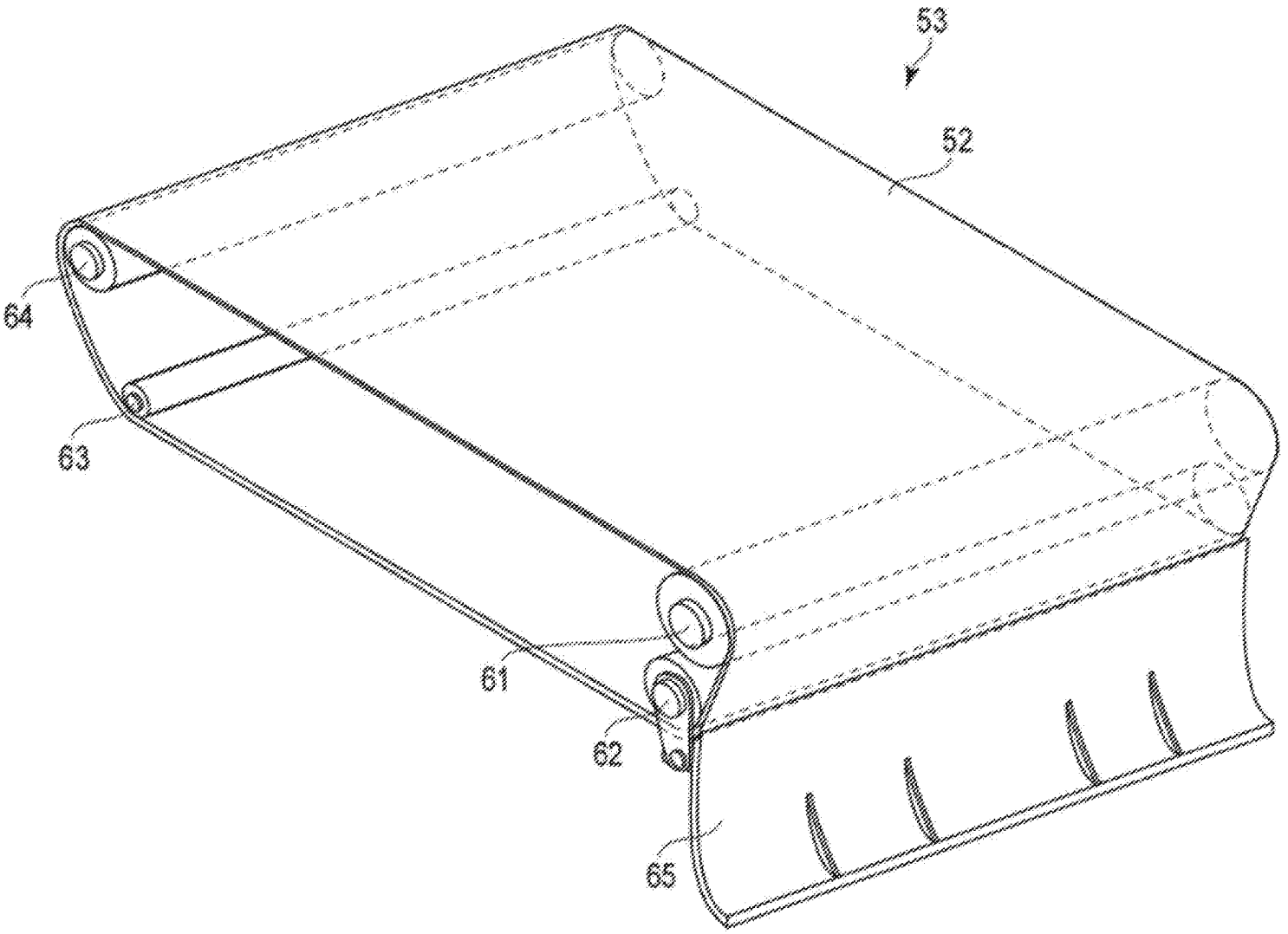
FIG. 3 is a diagram illustrating an example of a configuration of a primary transfer unit according to the first embodiment.

FIG. 3 is a diagram illustrating an example of a configuration of the primary transfer unit 53. The primary transfer unit 53 includes the primary transfer belt 52, a secondary transfer opposing roller 61, a first winding roller 62, a second winding roller 63, a third winding roller 64, and a guide before secondary transfer 65.

The primary transfer belt 52 is an endless belt that receives the toner image from the photoconductive drum 56 of the processing unit 51 and transfers the received toner image onto the print medium P. In other words, the primary transfer belt 52 has an outer circumferential surface and an inner circumferential surface. The primary transfer belt 52 is wound around the secondary transfer opposing roller 61, the first winding roller 62, the second winding roller 63, and the third winding roller 64. Specifically, the inner circumferential surface of the primary transfer belt 52 is in contact with the secondary transfer opposing roller 61, the first winding roller 62, the second winding roller 63, and the third winding roller 64. The secondary transfer opposing roller 61, the first winding roller 62, the second winding roller 63, and the third winding roller 64 are each rotated by a motor (not shown). The primary transfer belt 52 moves by the rotation of the secondary transfer opposing roller 61, the first winding roller 62, the second winding roller 63, and the third winding roller 64. The primary transfer belt 52 moves in the same direction as the print medium P at a winding portion around the secondary transfer opposing roller 61. With a movement direction of the primary transfer belt 52 as a reference, a front side in the movement direction of the primary transfer belt 52 is referred to as a downstream side, and a rear side in the movement direction of the primary transfer belt 52 is referred to as an upstream side.

The primary transfer belt 52 is arranged in such a matter that the outer circumferential surface thereof is in contact with the surface of the photoconductive drum 56 of the processing unit 51, i.e., the surface on which the toner image is held. The primary transfer belt 52 receives the toner image on the photoconductive drum 56 on the outer circumferential surface thereof at a position where the photoconductive drum 56 and the outer circumferential surface of the primary transfer belt 52 contact with each other. The primary transfer belt 52 moves by the rotation of rollers such as the secondary transfer opposing roller 61 to convey the toner image received from the photoconductive drum 56 to the transfer nip described later. The primary transfer belt 52 functions as the image holding member for holding the toner image on the outer circumferential surface thereof.

The guide before secondary transfer 65 is connected to the first winding roller 62 provided on the upstream side of the secondary transfer opposing roller 61 via a crank or the like, and functions as a guide of the sheet feed conveyance path 44.

The secondary transfer unit 54 presses the print medium P towards the primary transfer belt 52 of the primary transfer unit 53.

Figure 4:
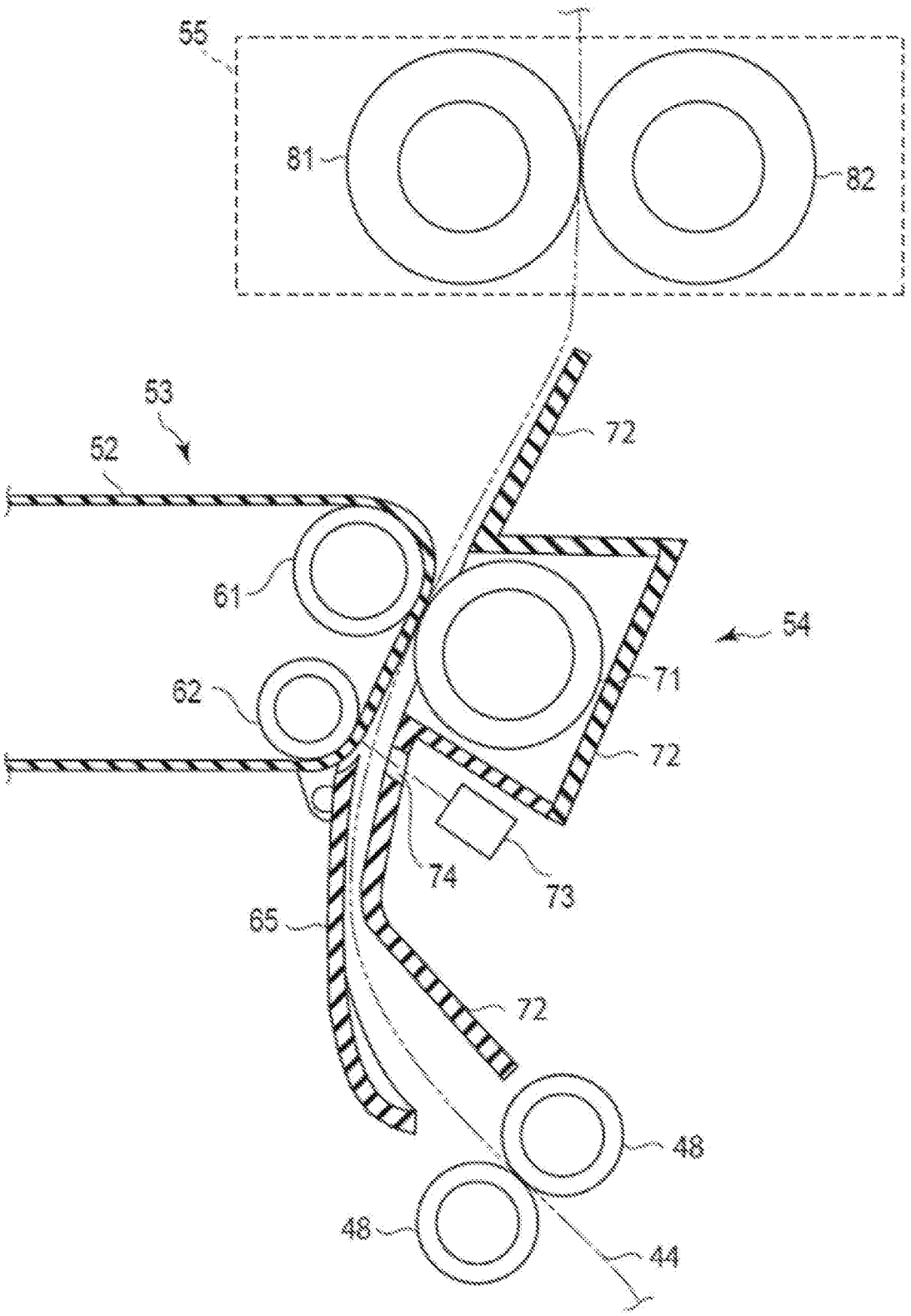
FIG. 4 is a diagram illustrating an example of configurations of the primary transfer unit, a secondary transfer unit, and a fixing unit according to the first embodiment.

FIG. 4 is a diagram illustrating configurations of a part of the primary transfer unit 53, the secondary transfer unit 54, and the fixing unit 55. In FIG. 4, a cross section obtained by cutting the chassis of the primary transfer belt 52, the guide before secondary transfer 65, and the secondary transfer unit 54 along a plane orthogonal to an axis of the secondary transfer opposing roller 61 is shown.

The secondary transfer unit 54 includes a secondary transfer roller 71, a chassis 72, and a photoelectric sensor 73.

The secondary transfer roller 71 applies pressure to the secondary transfer opposing roller 61 via the primary transfer belt 52. Thereby, the transfer nip is formed between the secondary transfer roller 71 and the winding portion of the primary transfer belt 52 around the secondary transfer opposing roller 61. The transfer nip is a region in which the secondary transfer roller 71 and the primary transfer belt 52 closely contact with each other.

The chassis 72 supports the secondary transfer roller and the photoelectric sensor 73. The chassis 72 constitutes a contour of the secondary transfer unit 54. Furthermore, together with the guide before secondary transfer 65, the chassis 72 also functions as a guide for guiding the print medium P send out by the registration rollers 48 of the sheet feed conveyance path 44 to the transfer nip where the primary transfer belt 52 and the secondary transfer roller 71 closely contact with each other. A slit 74 is provided at a position facing the primary transfer belt 52 of the chassis 72.

The photoelectric sensor 73 irradiates the predetermined range with the light and converts a reflected light of the irradiated light to an electric signal. The photoelectric sensor 73 has an illumination that emits the light to the predetermined range, and a light receiving section that receives the light from the predetermined range and converts it to the electric signal. For example, the predetermined range is a point of the surface of the image holding member on which a toner image is held. Specifically, the predetermined range is a point of the outer circumferential surface of the primary transfer belt 52. The light receiving section includes a light receiving element for converting the light to an electric signal and an optical system for imaging the light on the light receiving element. An optical axis of the optical system of light receiving section is referred to as a detection direction of the photoelectric sensor 73.

When the print medium P is conveyed by the sheet feed conveyance path 44, a plane through which the print medium P passes is referred to as a conveyance plane. The photoelectric sensor 73 is arranged between the registration roller 48 of the sheet feed conveyance path 44 and the transfer nip in such a manner that the detection direction intersects with the conveyance plane through the slit 74 of the chassis 72 and hits (faces) the surface of the primary transfer belt 52. Furthermore, the photoelectric sensor 73 is arranged in such a manner that the detection direction hits (faces) the winding portion towards the first winding roller 62 of the primary transfer belt 52. The position where the conveyance plane and the detection direction intersect with each other and a position where the surface of the primary transfer belt 52 and the detection direction intersect with each other each are referred to as a detection position. In a position which is away from the first winding roller 62 or the secondary transfer opposing roller 61, the primary transfer belt 52 may rattle. Therefore, it is desirable that the detection position on the surface of the primary transfer belt 52 is close to the first winding roller 62 or the secondary transfer opposing roller 61. For example, it is desirable that the detection position on the surface of the primary transfer belt 52 is provided at a position within 10 mm on the downstream side from the first winding roller 62.

In the above configuration, if the print medium P is supplied from the registration roller 48 of the sheet feed conveyance path 44 to the transfer nip, the print medium P passes through the transfer nip while being sandwiched between the primary transfer belt 52 and the secondary transfer roller 71. If the toner image is formed on the primary transfer belt 52, the toner image on the primary transfer belt 52 is transferred onto the print medium P when the print medium P passes through the transfer nip.

The fixing unit 55 fixes the toner image transferred onto the print medium P. The fixing unit 55 includes a heat roller 81 and a pressure roller 82. The heat roller 81 is heated to a high temperature by a heater (not shown). The pressure roller 82 presses the print medium P passing through the transfer nip against the heat roller 81. Specifically, the heat roller 81 and the pressure roller 82 apply heat and pressure to the print medium P. In this way, the toner image formed on the print medium P is fixed. As a result, an image is formed on the print medium P.

In the above configuration, the determination of the passage of the print medium P and an image quality adjustment operation are described.

The processor 31 of the system controller 11 sequentially receives detection signals from the photoelectric sensor 73. Based on the detection signal received from the photoelectric sensor 73, the processor 31 determines the passage of the print medium P and adjusts the image quality.

First, the image quality adjustment operation is described. The processor 31 forms a toner image (image quality adjustment patch) of a predetermined pattern on the primary transfer belt 52 with the processing unit 51 in a state in which no print medium P is conveyed. The processor 31 operates the secondary transfer opposing roller 61, the first winding roller 62, the second winding roller 63, and the third winding roller 64 to move the image quality adjustment patch formed on the primary transfer belt 52 to the detection position of the photoelectric sensor 73. If the image quality adjustment patch formed on the primary transfer belt 52 reaches the detection position of the photoelectric sensor 73, the photoelectric sensor 73 detects a reflected light reflected by the image quality adjustment patch. In this case, the photoelectric sensor 73 outputs a detection signal corresponding to the density of the image quality adjustment patch.

Based on the detection signal detected by the photoelectric sensor 73 from the image quality adjustment patch, the processor 31 determines whether or not the processing unit 51 forms a toner image with the correct density on the primary transfer belt 52. The processor 31 adjusts the density of the toner image formed by the processing unit 51 based on the detection signal detected by the photoelectric sensor 73 from the image quality adjustment patch. Thus, the processor 31 can adjust the image quality based on the detection signal of the photoelectric sensor 73.

Next, the determination of the passage of the print medium P is described. After taking the print medium P into the sheet feed conveyance path 44, the processor 31 determines whether or not the print medium P passes through the detection position of the photoelectric sensor 73. In this way, despite that the conveyance section 20 is operating, the processor 31 determines whether or not a state (jam) in which no print medium P is conveyed within the housing 41 based on the detection signal from the photoelectric sensor 73.

For example, if the print medium P is present in the detection direction of the photoelectric sensor 73, the photoelectric sensor 73 detects the reflected light reflected by the surface of the print medium P. Therefore, when the print medium P is present in the detection direction of the photoelectric sensor 73, a high-level detection signal is output from the photoelectric sensor 73.

On the other hand, for example, if no print medium P is present in the detection direction of the photoelectric sensor 73, the photoelectric sensor 73 detects the reflected light reflected by the surface of the primary transfer belt 52. For example, the surface of the primary transfer belt 52 is black. Therefore, when no print medium P is present in the detection direction of the photoelectric sensor 73, a low-level detection signal is output from the photoelectric sensor 73.

If the print medium P is being conveyed and the detection signal from the photoelectric sensor 73 changes from a low level to a high level, the processor 31 determines that the print medium P reaches the detection position of the photoelectric sensor 73. If the print medium P is being conveyed and the detection signal of the photoelectric sensor changes from the high level to the low level, the processor 31 determines that the print medium P already passes through the detection position of the photoelectric sensor 73.

If the print medium P is being conveyed and the print medium P does not reach the detection position of the photoelectric sensor 73 within a predetermined period of time since the conveyance of the print medium P is started, the processor 31 determines that the print medium P does not reach the transfer nip (i.e., the jam occurs). If the print medium P is being conveyed and then reaches the detection position of the photoelectric sensor 73 within the predetermined period of time since the conveyance of the print medium P is started, the processor 31 determines that the print medium P reaches the transfer nip (i.e., no jam occurs).

If the high-level detection signal is output from the photoelectric sensor 73 for a predetermined period of time or more after the print medium P reaches the detection position of the photoelectric sensor 73, the processor 31 determines that the jam occurs nearby the transfer nip.

As described above, despite that the conveyance section 20 is operating, the processor 31 can determine whether or not the state (jam) in which no print medium P is conveyed in the housing 41 based on the detection signal of the photoelectric sensor 73. If it is determined that the jam occurs, the processor 31 notifies that the jam occurs with the display section 14 and/or the speaker 15 and stops the operations of the image forming section 21 and the conveyance section 20.

As described above, the image forming apparatus 1 includes the conveyance section 20 for conveying the print medium P, the image forming section 21, and the processor 31. The image forming section 21 includes a plurality of the processing units 51 for forming toner images, the primary transfer unit 53, and the secondary transfer unit 54. The primary transfer unit 53 includes the primary transfer belt 52 that transfers the toner image formed by the processing unit 51 onto the print medium P, and the secondary transfer opposing roller 61 that moves the primary transfer belt 52. The secondary transfer unit 54 includes the secondary transfer roller 71 which forms the transfer nip by closely contacting with the winding portion of the primary transfer belt 52 around the secondary transfer opposing roller 61, and the photoelectric sensor 73 intersecting with the conveyance plane on which the print medium P is conveyed and facing the surface of the primary transfer belt 52. In the above configuration, based on the detection result of the photoelectric sensor 73, the processor 31 determines the passage of the print medium P and determines whether or not the density of the toner image formed by the processing unit 51 is the preset density.

In this way, the image forming apparatus 1 can detect the density of the toner image and detect the passage of the print medium P using one photoelectric sensor 73. As a result, there is no need to provide both the image quality adjustment sensor and the passage sensor. As a result, the cost of the image forming apparatus 1 can be reduced.

In the above embodiment, each unit of the image forming section 21 is attached to the housing 41, for example, and in this way, a distance between the units is properly maintained. For example, the primary transfer unit 53 and the secondary transfer unit 54 are attached to the housing by adjusting the distance therebetween so that the pressure is applied from the secondary transfer roller 71 to the winding portion of primary transfer belt 52 around the secondary transfer opposing roller 61

Furthermore, the primary transfer unit 53 and the secondary transfer unit 54 may be attached to the housing 41 in a state in which they are integrated with each other. In this case, the primary transfer unit 53 has an attachment section for attaching the secondary transfer unit 54. If the primary transfer unit 53 and the secondary transfer unit 54 are integrated with each other, the attachment section is configured so that the pressure is applied from the secondary transfer roller 71 to the winding portion of the primary transfer belt 52 around the secondary transfer opposing roller 61. According to the configuration, a tolerance between the housing 41 and the primary transfer unit 53, and a tolerance between the housing 41 and the secondary transfer unit 54 can be excluded from the distance between the winding portion of the primary transfer belt 52 around the secondary transfer opposing roller 61 and the secondary transfer roller 71. Therefore, it is possible to improve the accuracy of the distance between the winding portion of the primary transfer belt 52 around the secondary transfer opposing roller 61 and the secondary transfer roller 71.

Second Embodiment

The second embodiment is described below.

In the second embodiment, the configurations of the primary transfer unit 53 and the secondary transfer unit 54 are different from those of the first embodiment. The same reference numerals are denoted to the same components as those of the first embodiment, and a detailed description thereof is omitted.

Figure 5:
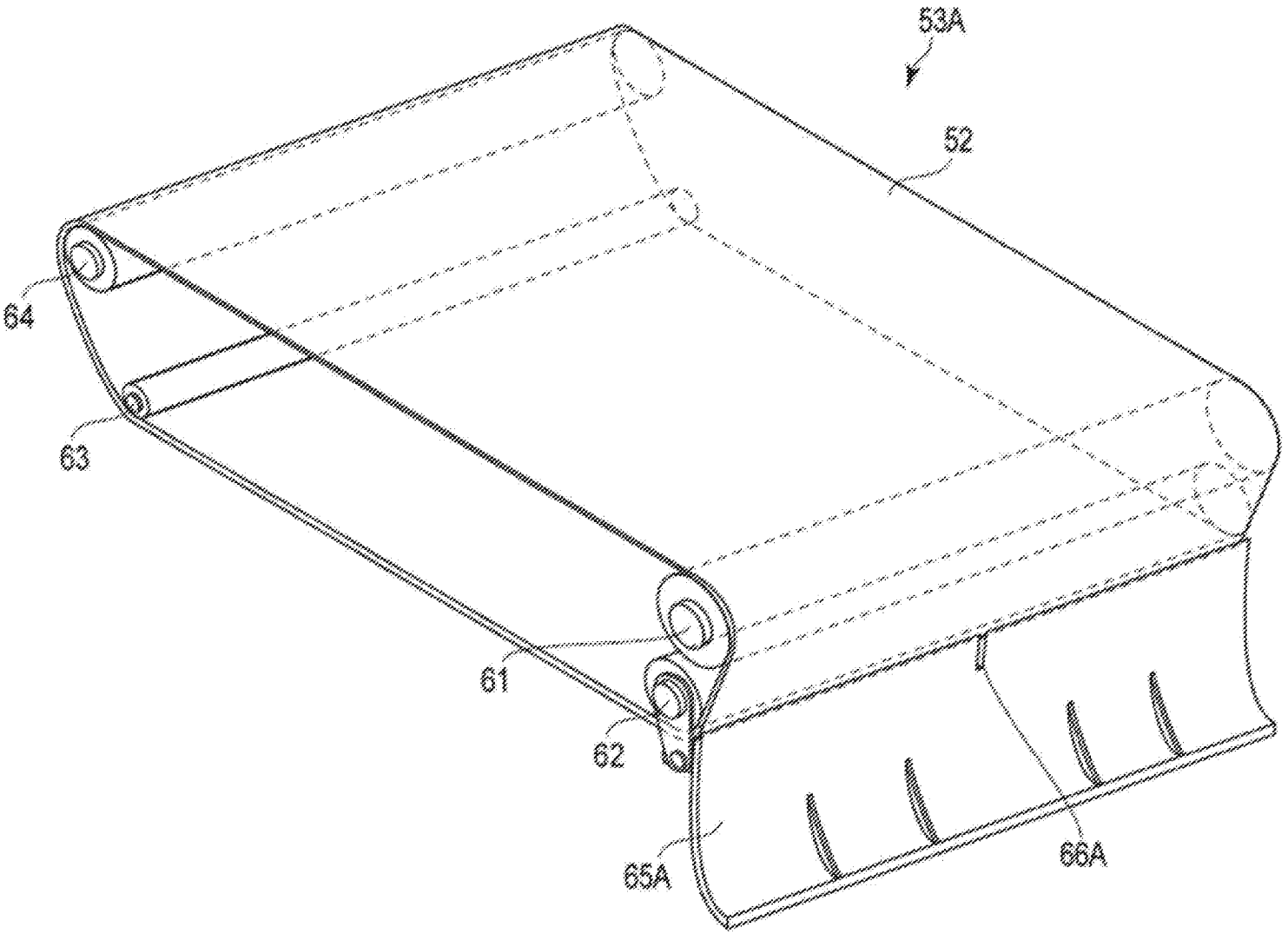
FIG. 5 is a diagram illustrating an example of a configuration of a primary transfer unit according to a second embodiment.

FIG. 5 is a diagram illustrating an example of a configuration of a primary transfer unit 53A according to the second embodiment.

The primary transfer unit 53A includes the primary transfer belt 52, the secondary transfer opposing roller 61, the first winding roller 62, the second winding roller 63, the third winding roller 64, and a guide before secondary transfer 65A.

Figure 6:
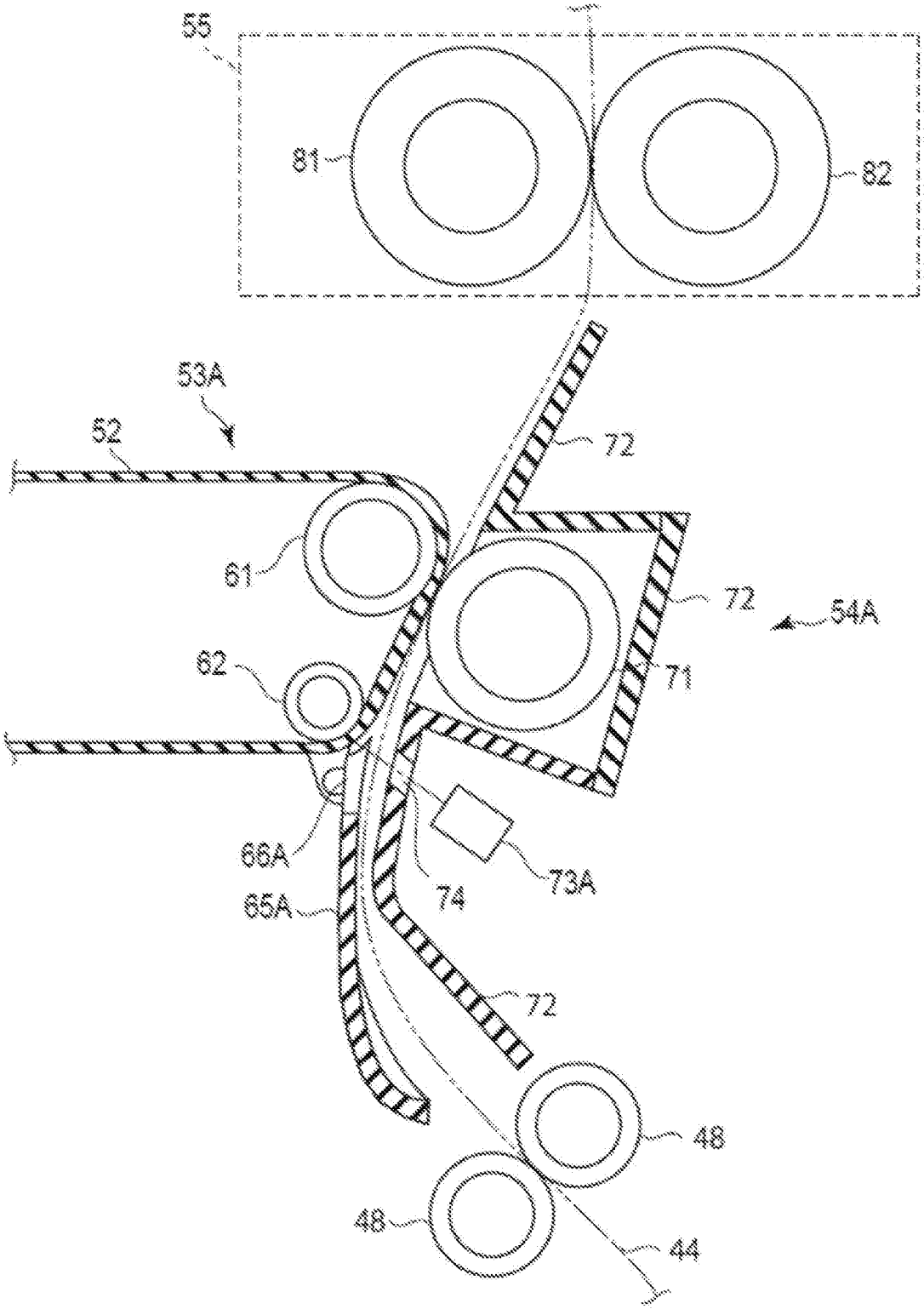
FIG. 6 is a diagram illustrating an example of configurations of the primary transfer unit, a secondary transfer unit, and a fixing unit according to the second embodiment.

FIG. 6 is a diagram illustrating the configurations of a part of the primary transfer unit 53A, the secondary transfer unit 54A and the fixing unit 55 according to the second embodiment. In FIG. 6, a cross section obtained by cutting the primary transfer belt 52, the guide before secondary transfer 65A, and the chassis 72 along a plane orthogonal to the axis of the secondary transfer opposing roller 61 is shown.

The secondary transfer unit 54A includes the secondary transfer roller 71, the chassis 72, and a photoelectric sensor 73A.

The photoelectric sensor 73A is different from the photoelectric sensor 73 in the detection direction. The detection direction of the photoelectric sensor 73 A is arranged so as to cross the conveyance plane at a position closer to the registration roller 48 than the detection direction of the photoelectric sensor 73.

A detection direction of the photoelectric sensor 73A is close to the registration roller 48, and in this way, there is a possibility that the light is blocked by the guide before secondary transfer of the primary transfer unit 53A. Therefore, the guide before secondary transfer 65A has a slit 66A provided at a position overlapping with the detection direction of the photoelectric sensor 73A.

According to the above configuration, since the detection position of the photoelectric sensor 73A is close to the registration roller 48, the image forming apparatus 1 can detect occurrence of the jam at an earlier timing when compared with the first embodiment.

Third Embodiment

Hereinafter, a third embodiment is described.

In the third embodiment, the configurations of the primary transfer unit 53 and the secondary transfer unit 54 are different from those of the first embodiment. The same reference numerals are denoted to the same components as those of the first embodiment, and a detailed description thereof is omitted.

Figure 7:
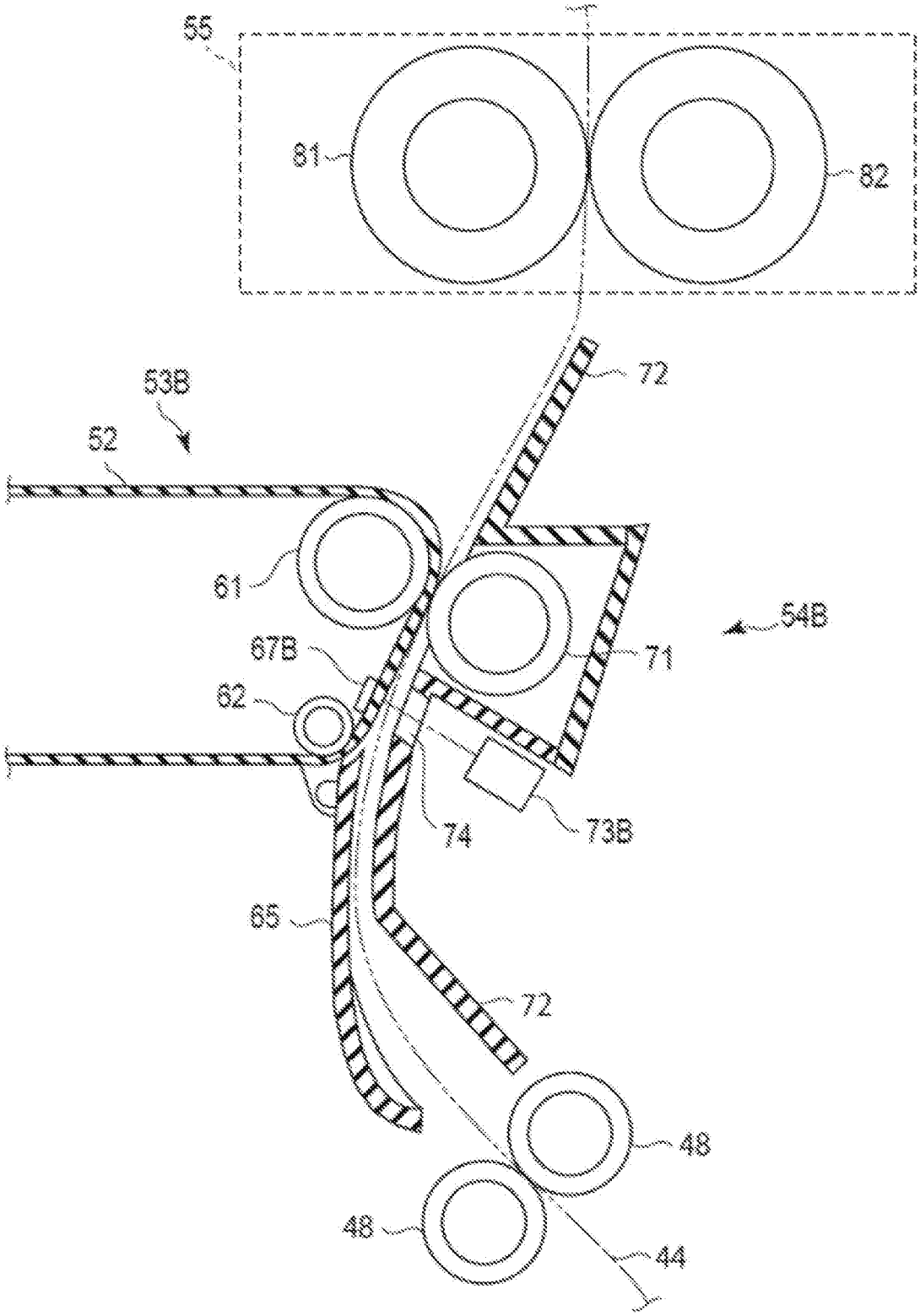
FIG. 7 is a diagram illustrating an example of configurations of a primary transfer unit, a secondary transfer unit, and a fixing unit according to a third embodiment.

FIG. 7 is a diagram illustrating the configurations of a part of a primary transfer unit 53B according to the third embodiment, a secondary transfer unit 54B according to the third embodiment, and the fixing unit 55. In FIG. 7, a cross section obtained by cutting the primary transfer belt 52, the guide before secondary transfer 65, and the chassis 72 along a plane orthogonal to the axis of the secondary transfer opposing roller 61 is shown.

The primary transfer unit 53B includes the primary transfer belt 52, the secondary transfer opposing roller 61, the first winding roller 62, the second winding roller 63, the third winding roller 64, the guide before secondary transfer 65, and a sensor opposing pad 67B.

The sensor opposing pad 67B of the primary transfer unit 53B is arranged between a winding portion around the first winding roller 62 and a winding portion around the secondary transfer opposing roller 61 to contact with the primary transfer belt 52 from a side facing the photoelectric sensor 73. The sensor opposing pad 67B prevents the primary transfer belt 52 from vibrating during movement.

The secondary transfer unit 54B includes the secondary transfer roller 71, the chassis 72, and the photoelectric sensor 73B.

The photoelectric sensor 73B is arranged in such a manner that a detection direction thereof intersects with the conveyance plane and a detection position is formed on the surface of the side of the primary transfer belt 52 opposite to the sensor opposing pad 67B.

According to the above configuration, the photoelectric sensor 73B can detect the image adjustment patch from the planar surface of the primary transfer belt 52. The photoelectric sensor 73B can improve the detection accuracy of the density of the toner of the image adjustment patch when compared with a case of detecting the image adjustment patch from the curved surface of the primary transfer belt 52.

Fourth Embodiment

The fourth embodiment is described below.

In the fourth embodiment, the structure of the secondary transfer unit 54 is different from that of the first embodiment. The same reference numerals are denoted to the same components as those of the first embodiment, and a detailed description thereof is omitted.

Figure 8:
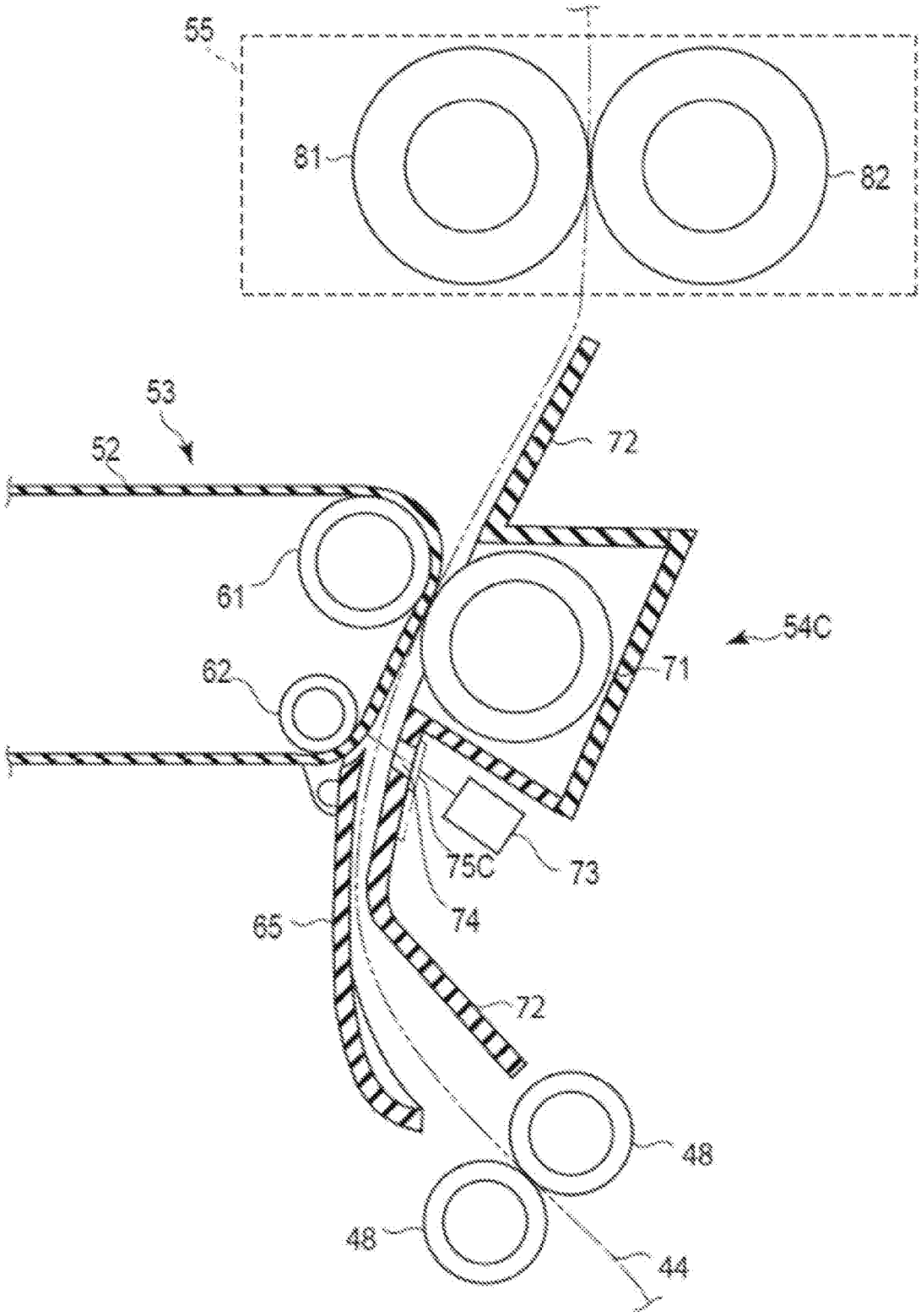
FIG. 8 is a diagram illustrating an example of configurations of a primary transfer unit, a secondary transfer unit, and a fixing unit according to a fourth embodiment.

FIG. 8 is a diagram illustrating the configurations of a part of the primary transfer unit 53, a secondary transfer unit 54C according to the fourth embodiment, and the fixing unit 55. In FIG. 8, a cross section obtained by cutting the primary transfer belt 52, the guide before secondary transfer 65, and the chassis 72 along a plane orthogonal to the axis of the secondary transfer opposing roller 61 is shown.

The secondary transfer unit 54C includes the secondary transfer roller 71, the chassis 72, the photoelectric sensor 73, and a shutter 75C.

The shutter 75C is a sealing member for sealing the slit 74 formed in the chassis 72. The shutter 75C operates by a motor (not shown), thereby switching a state of the slit 74 between a sealed state and an open state.

For example, the processor 31 controls the shutter 75C to seal the slit 74 in a normal state. When performing the image quality adjustment using the image quality adjustment patch, the processor 31 controls the shutter 75C to open the slit 74. If the conveyance of the print medium P is started, the processor 31 controls the shutter 75C to open the slit 74. Furthermore, if the processor 31 determines that the print medium P reaches the detection position of the photoelectric sensor 73, the processor 31 may control the shutter 75C to seal the slit 74.

According to the above configuration, it is possible to prevent paper dust from entering the chassis 72 of the secondary transfer unit 54C from the slit 74 and adhering to the photoelectric sensor 73.

In the above embodiment, the photoelectric sensor 73 irradiates the surface of the primary transfer belt 52 which is the image holding member with the light, and converts the reflected light reflected at one point on the surface of the primary transfer belt 52 to an electric signal; however, it is not limited to that configuration. The image holding member may be a surface holding the toner image on the surface of the photoconductive drum 56. In other words, the photoelectric sensor 73 may irradiate the surface of the photoconductive drum 56 which is the image holding member with the light, and then convert the reflected light reflected at one point on the surface of the photoconductive drum 56 to an electric signal.

In the above embodiment, in the image forming apparatus 1, a toner image is formed on the photoconductive drum 56 and the primary transfer belt 52 receives the toner image of the photoconductive drum 56. However, it is not limited to that configuration. The image forming apparatus 1 may form a toner image on the photoconductive drum and transfer the toner image from the photoconductive drum onto the print medium P. In other words, the photoconductive drum may be configured as an intermediate transfer drum. In this case, the photoelectric sensor 73 also irradiates the surface of the photoconductive drum which is the image holding member with the light and converts the reflected light reflected at one point on the surface of the photoconductive drum to an electric signal.

The photoelectric sensor 73 may have any configuration as long as the detection direction intersects with the conveyance plane on which the print medium P is conveyed, and it can acquire the reflected light on the surface of the image holding member on which the toner image is held. The image holding member may have any member as long as it can move the toner image while holding it, such as the primary transfer belt 52, the photoconductive drum 56 of the processing unit 51, and the photoconductive drum configured as an intermediate transfer drum.

The functions described in the above embodiments can be realized by reading programs describing respective functions into a computer using software in addition to using the hardware. Each function may be configured by selecting software or hardware as appropriate.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a conveyance section configured to convey a print medium;

a processing unit configured to form a toner image;

an image holding member configured to move the toner image formed by the processing unit;

a photoelectric sensor facing the image holding member such that a detection direction intersects with a conveyance plane on which the print medium is conveyed; and a processor configured to determine passage of the print medium based on a detection result of the photoelectric sensor, and to determine whether or not a density of the toner image formed by the processing unit is a preset density and adjust the density of the toner image.

2. The image forming apparatus according to claim 1, further comprising:

a secondary transfer opposing roller configured to move a primary transfer belt which is the image holding member and receives the toner image from the processing unit on an outer circumferential surface thereof to transfer the toner image onto the print medium; and a secondary transfer roller positioned proximate the primary transfer belt to form a transfer nip therebetween, wherein the photoelectric sensor reads reflected light from an outer circumferential surface of the primary transfer belt.

3. The image forming apparatus according to claim 2, further comprising:

a winding roller provided on an upstream side of the secondary transfer opposing roller in the movement direction of the primary transfer belt, wherein a detection position of the photoelectric sensor is the outer circumferential surface of the primary transfer belt between a winding portion around the secondary transfer opposing roller and a winding portion around the winding roller.

4. The image forming apparatus according to claim 3, further comprising:

a guide before secondary transfer configured to guide the print medium to the transfer nip, and the guide before secondary transfer has a slit provided at a position overlapping with the detection direction of the photoelectric sensor.

5. The image forming apparatus according to claim 3, further comprising:

a sensor opposing pad configured to contact an inner circumferential surface of the primary transfer belt between a winding portion around the secondary transfer opposing roller and a winding portion around the winding roller.

6. The image forming apparatus according to claim 2, wherein the photoelectric sensor is provided in a secondary transfer unit associated with the secondary transfer roller.

7. The image forming apparatus according to claim 6, wherein the secondary transfer unit is at a position where pressure is applied from the secondary transfer roller to the secondary transfer opposing roller through the primary transfer belt.

8. The image forming apparatus according to claim 6, wherein the primary transfer belt and the secondary transfer opposing roller are integrated with the secondary transfer unit, and are housed in a housing of the image forming apparatus.

9. The image forming apparatus according to claim 6, wherein the secondary transfer unit comprises a chassis for supporting the secondary transfer roller and the photoelectric sensor, and the chassis has a slit provided at a position overlapping with the detection direction of the photoelectric sensor.

10. The image forming apparatus according to claim 9, wherein the secondary transfer unit comprises a shutter that switches a state of the slit between a sealed state and an open state.

11. The image forming apparatus according to claim 1, wherein the processor determines whether or not a density of the toner image formed by the processing unit is the preset density when the photoelectric sensor outputs a detection signal corresponding to a density of an image quality adjustment patch.

12. The image forming apparatus according to claim 1, wherein the processor determines passage of the print medium when the processor determines whether or not a jam state exists based on a detection signal from the photoelectric sensor.

13. A control method by an image forming apparatus comprising a conveyance section that conveys a print medium, a processing unit that forms a toner image, an image holding member configured to move the toner image formed by the processing unit, a photoelectric sensor facing the image holding member such that a detection direction intersects with a conveyance plane on which the print medium is conveyed, and a processor, comprising:

determining passage of the print medium based on a detection result of the photoelectric sensor, and determining whether or not a density of the toner image formed by the processing unit is a preset density and adjusting the density of the toner image.

14. The control method according to claim 13, further comprising:

moving a primary transfer belt which is the image holding member and receiving the toner image from the processing unit on an outer circumferential surface thereof to transfer the toner image onto the print medium; and reading reflected light from an outer circumferential surface of the primary transfer belt.

15. The control method according to claim 14, wherein a winding roller is provided on an upstream side of a secondary transfer opposing roller in the movement direction of the primary transfer belt, wherein a detection position of the photoelectric sensor is the outer circumferential surface of the primary transfer belt between a winding portion around the secondary transfer opposing roller and a winding portion around the winding roller.

16. The control method according to claim 15, further comprising:

guiding the print medium to a transfer nip.

17. The control method according to claim 15, further comprising:

contacting with a winding portion of the primary transfer belt, on an inner circumferential surface, around the secondary transfer opposing roller and a winding portion around the winding roller.

18. The control method according to claim 14, further comprising:

supporting the secondary transfer roller and the photoelectric sensor on a chassis, wherein the chassis has a slit provided at a position overlapping with the detection direction of the photoelectric sensor.

19. The control method according to claim 13, wherein determining whether or not a density of the toner image formed by the processing unit is the preset density by the photoelectric sensor outputting a detection signal corresponding to a density of an image quality adjustment patch.

20. The control method according to claim 13, wherein determining passage of the print medium by determining whether or not a jam state exists based on a detection signal from the photoelectric sensor.

* * * * *